US008756724B1

(12) United States Patent
Lordahl et al.

(10) Patent No.: US 8,756,724 B1
(45) Date of Patent: Jun. 24, 2014

(54) UNIVERSAL TUB OVERFLOW COVER ASSEMBLY AND KIT

(75) Inventors: Var Lordahl, Long Grove, IL (US); Bruce L. Graham, Gurnee, IL (US)

(73) Assignee: Var E. Lordahl, Long Grove, IL (US)

( * ) Notice: Subject to any disclaimer, the term of this patent is extended or adjusted under 35 U.S.C. 154(b) by 361 days.

(21) Appl. No.: 13/136,842

(22) Filed: Aug. 12, 2011

(51) Int. Cl.

| | |
|---|---|
| ***E03C 1/24*** | (2006.01) |
| ***E03C 1/244*** | (2006.01) |
| ***E03C 1/042*** | (2006.01) |
| ***E03C 1/232*** | (2006.01) |

(52) U.S. Cl.
USPC ..... 4/680; 4/694; 4/683; 4/695

(58) Field of Classification Search
USPC ..... 4/680, 694, 695, 683, 651
See application file for complete search history.

(56) References Cited

U.S. PATENT DOCUMENTS 6,073,278 A * 6/2000 Ball ..... 4/694

* cited by examiner

*Primary Examiner* — Gregory Huson
*Assistant Examiner* — Christine Skubinna
(74) *Attorney, Agent, or Firm* — Kajane McManus

(57) ABSTRACT

An overflow cover assembly and kit for making same comprising at least a cover piece including a snap on section and a hanger which is configured to engage a bracket crossing and engaged over a port of an overflow system, the hanger mounting to the overflow port bracket using screws from the previous hanger engaged thereto and the cover piece being engaged to the hanger by two screws provided in the kit, the cover assembly accommodating replacement of either one or two screw cover embodiments and being provided in various finishes and in regular size or being oversized.

7 Claims, 4 Drawing Sheets

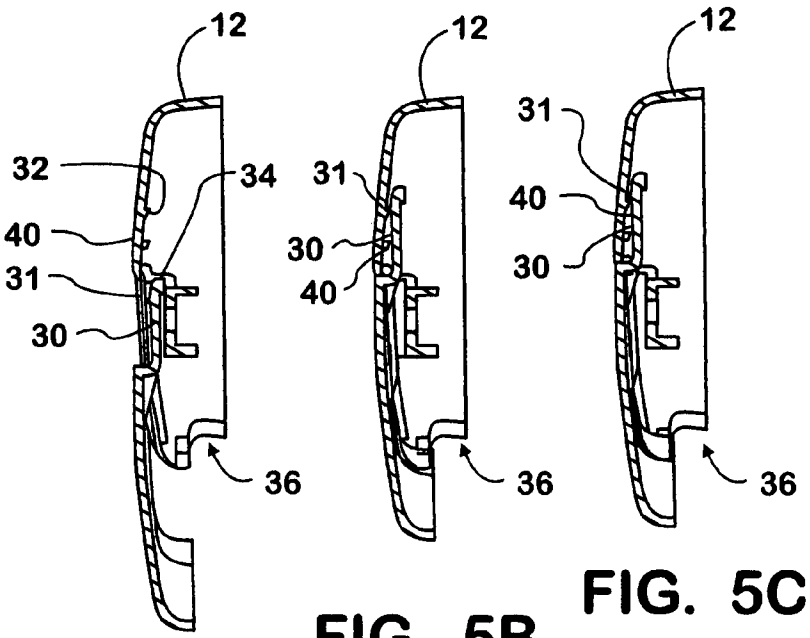
FIG. 5C
FIG. 5B
FIG. 5A
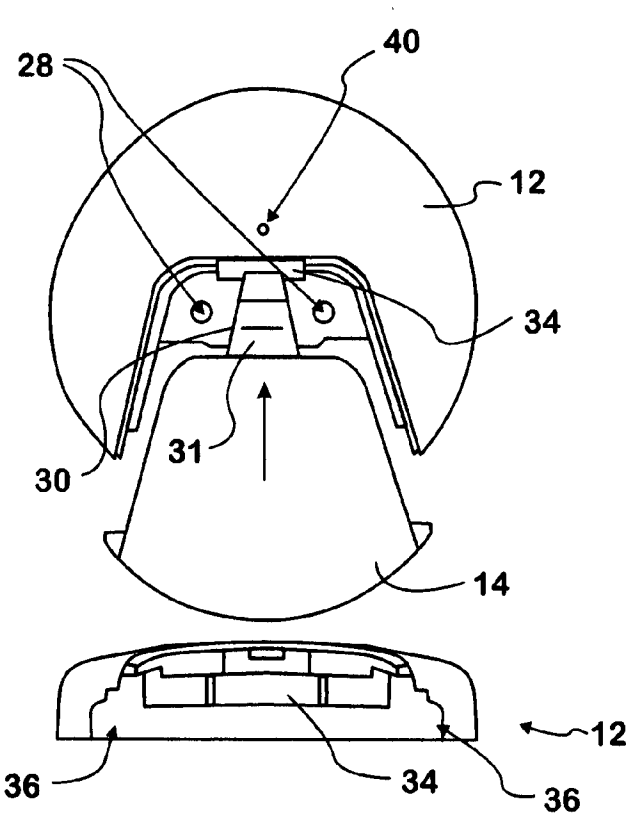
FIG. 3
FIG. 4

UNIVERSAL TUB OVERFLOW COVER ASSEMBLY AND KIT

BACKGROUND OF THE INVENTION

1. Field of the Invention

The present invention relates to universal bath tub overflow assemblies, which historically have been made in one size. Building codes require a tub overflow assembly to be incorporated in bath tubs and nearly all of these assemblies incorporate an outer exposed cover plate located on the front side of the bath tub above the drain. This exposed plate is the subject of this application. The overflow cover plate assembly nearly always is attached to the waste assembly using one or two screws, which historically are exposed and are necessarily plated to match the finish of the cover plate.

2. Prior Art

In the United States and most other countries, all bath tubs are required by code to incorporate a waste and overflow system into the drain assembly. Usually these systems incorporate a vent or port located above the drain which usually is covered by a round or rectangle plate, which necessarily plated to match the trim of tub (chrome, nickel, brass, etc.) which is affixed with one or two matching exposed screws. Some models incorporate a flip lever which controls the tub drain, but most do not.

The universal overflow cover assembly of the present invention serves as a replacement for these round or rectangular plates, with or without a flip lever.

Over time, such plates routinely discolor or the tub discolors around the 00 of the plate. When this happens they are changed, either in the same plated finish or, in a new plated finish in situations where the bathroom, during remodeling, is having the bathtub faucet finish changed, such as, from chrome finish to gold, brushed nickel or oil rubbed bronze finish.

Heretofore the cover plates have always been made the same size (00). Also, some manufactures use one screw and others use two screws to attach them over the overflow system port. And finally, not all screw lengths and thread sizes are/were the same.

Because of this, the market has faced the following problems while replacing these cover plates:

1. Older bath tubs which have developed discoloration around the plate still have the discoloration showing after installing a new plate because all have been produced in only one diameter (00).
2. New screws have had to be provided in special finishes to match the plate, in different lengths and of different thread sizes to accommodate replacement of same, at great expense and causing confusion.

Accordingly, there is a need for a solution to these problems, which the universal overflow cover assembly and kit of the present invention solves.

SUMMARY OF THE INVENTION

According to the invention there is provided a universal tub overflow cover assembly and kit comprising a hanger, two set screws, and a two piece snap together cover plate, the assembly providing the following benefits:

1. It may be provided in an oversized configuration, if desired, for covering tub discoloration around the area of the vent or port of the overflow system
2. It uses the existing screws of the plate to be replaced, thereby eliminating all screw issues such as the plating color, length, or the thread size.

3. It accommodates various present day finishes to be matched in its environment.
4. It only needs only to be sold with 2jeach very inexpensive, small standard set screws.

BRIEF DESCRIPTION OF THE DRAWINGS

FIG. 3 is a top plan view of the cover piece and snap on section of the assembly and kit.

FIG. 4 is a cross section of the cover piece of the assembly and kit.

FIG. 5A is another cross section showing the snap on section partially inserted into the cover piece.

FIG. 5B is another cross section showing the snap on section further inserted into the cover piece.

FIG. 5C is another cross section showing the snap on section in its engaged position relative to the cover piece.

DESCRIPTION OF THE PREFERRED EMBODIMENT

Figure 1:
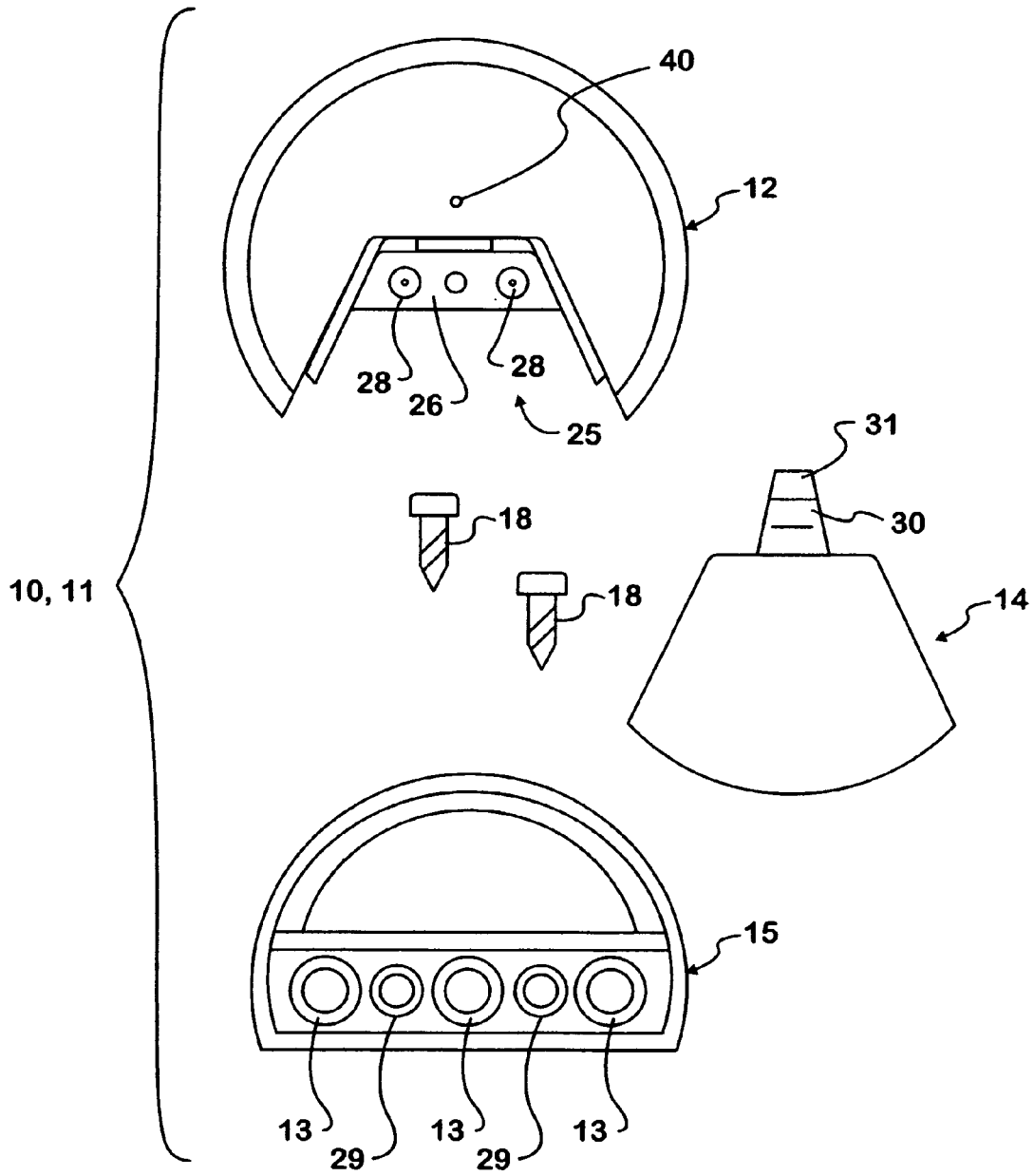
FIG. 1 is a perspective view of the sections and pieces of the universal overflow cover assembly and kit of the present invention comprising a cover piece, a snap on section, a hanger and two connectors.

Referring now to the drawings in greater detail, there is illustrated in the Figures the universal overflow cover assembly 10 made in accordance with the teachings of the present invention.

As shown, the assembly 10 is preferably provided as or in a kit 11 and comprises a cover piece 12 to which a snap on section 14 engages and a hanger 15 which is used to engage the cover piece 12 and attachable snap on section 14 over a port 16 of an overflow system 17 (FIGS. 6A-6E), using original screws 19 from a previous cover (not shown) being replaced by the assembly 10 of the kit 11 of the present invention.

Also provided are at least two connectors 18, such as screws 18 which are used to engage the cover piece 12 to the hanger 15, which screws 18 will not be visible once the snap on section 14 is engaged to the cover piece 12.

The overflow system port 16 includes a cross bracket 20 which crosses a diameter of the port 16 and accommodates engagement thereof to either a one screw or two screw embodiment of a present day overflow cover. To this cross bracket 20 is usually engaged a hanger from an old cover which is removed by disengaging the screws 19 holding it in place. These screws 19 are reused in attachment of the hanger 15 via slots 13 therein, provided in the assembly 10 and kit 11. It will be understood that the slots 13 are positioned to accommodate either a one screw or two screw embodiment of the cross bracket 20. Once the hanger 15 is engaged to the cross bracket 20 of the port 16, securely, in a manner pulling the port 16 of outlet pipe 24 of the overflow system 17 securely against the hanger 15 and ensuring that a seal or sealing ring (not shown) of the overflow system 17 is tightly held against the hanger 15, the cover piece 12 is next engaged to the hanger 15.

Figure 2:
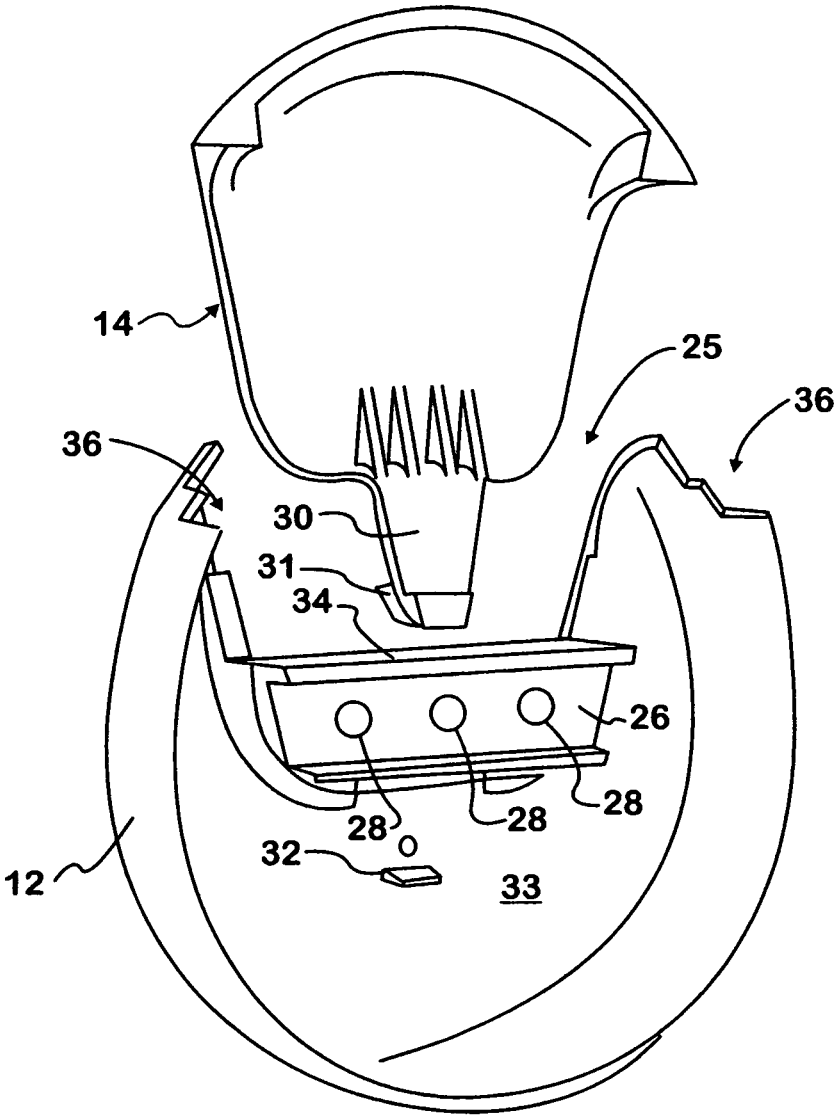
FIG. 2 is a perspective view of the disengaged undersides of the cover piece and snap on section of the assembly and kit.
Figures 6A, 6B:
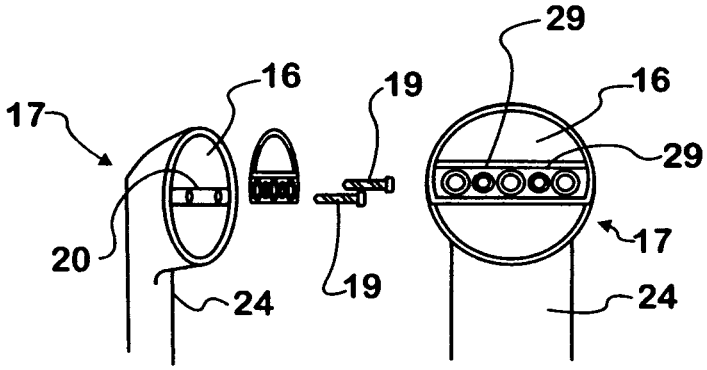
FIGS. 6A-6E show the simple steps of attaching the overflow cover assembly kit pieces to the overflow tube of the overflow system of a tub.
Figure 6C:
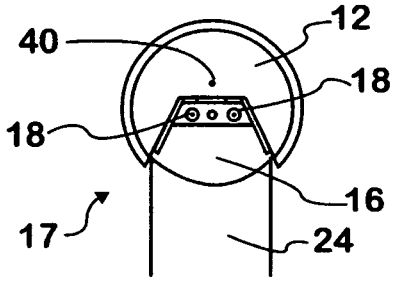
Figures 6D, 6E:
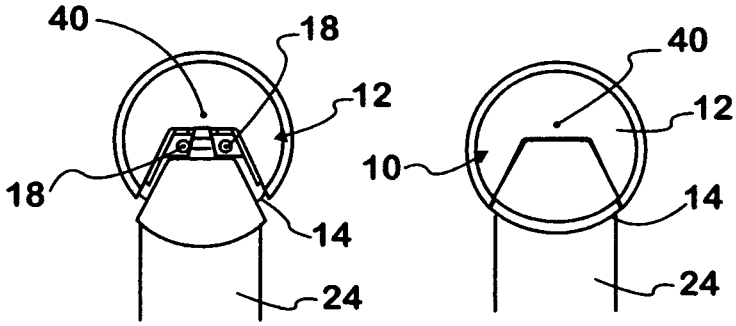

It will be understood that a tub overflow cover is typically round, however this should not be construed as limiting inasmuch as the cover assembly may be provided in any useable shape. The illustrated cover piece 12 defines a major portion of a circular periphery of the round cover assembly 10 with a pie shaped cut out 25 therein. The cover piece 12 also incorporates a cover bracket 26 on an underside 33 thereof having slots 28 extending therethrough which align with openings 29 provided in the hanger 15. Once the hanger is secured to the cross bracket 20 and the cover piece 12 is suitably engaged thereover, the screws or connectors 18 provided in the kit 11 are passed through the slots 28 in the cover bracket 26, through the aligned openings 29 in the hanger 15 and then engaged to the screw slots 31 in the cross bracket 20, holding the cover piece 12 over the port 16, as best shown in FIG. 6. After the cover piece 12 is engaged in this manner, the snap on section 14, which is triangularly or pie piece shaped and configured to create a completely circular overflow cover assembly 10 once engaged to the cover piece 12, is secured to the cover 12 as shown in FIGS. 5A-5C. The snap on section 14 includes an engagement tongue 30 thereon which has an engagement member 31 thereon configured to engage an engagement tab 32 provided on the underside 33 of the cover piece 12 as shown in FIG. 2. The tongue 30 fits through an opening 34 provided in the cover piece 12 (FIG. 4) in a relatively centered position thereon, with the snap on section 14, when engaged as shown in FIG. 6E, creating a complete, circular cover assembly 10 for the overflow system 17 of a tub (not shown). The cover assembly 10 includes ports 36 in lower peripheral sidewall areas thereof through which any water in the tub rising above the level of the ports 36 flows out and into the overflow system 17, to keep from creating an overflow condition.

The cover assembly 10, when completed, provides a circular cover assembly 10 which has no screws or connectors showing and which can be made in the typical present day diameter or can be made of an increased diameter to cover any discolorations in the tub area surrounding the overflow port 16.

It will be understood that there may be an occasion upon which the cover assembly 10 must be removed from its engagement. For this purpose, a hole 40 is provided in the cover piece 12 which is aligned over the tongue 30 such that insertion of the top of a small tool or other object into the hole will produce a disengagement between engagement member 31 of the tongue 30 and the engagement tab 32, providing access to the screws 18.

As described above, the overflow cover assembly 10 and kit 11 of the present invention provides advantages over the prior art and advantages inherent in its design. Also, modifications may be proposed to the assembly without departing from the teachings herein. Accordingly the scope of the invention is only to be limited as necessitated by the accompanying claims.

We claim:

1. An overflow cover assembly including a cover piece including a snap on section and a hanger which is configured to engage a bracket crossing and engaged over a port of an overflow system, the hanger mounting to the overflow port bracket using screws from a previous hanger engaged thereto, and wherein the cover piece includes a hole therein which allows for disengagement of the snap on section therefrom.

2. The overflow cover assembly of claim 1 wherein the cover piece includes ports in a lower periphery portion thereof through which water reaching the level of the ports enters the overflow system.

3. The overflow cover assembly of claim 1, further including two screws, wherein the cover piece and the snap on section that engage the cross bracket of the port of the overflow system via the hanger sandwiched between the cross bracket and a cooperating cover bracket on the cover piece, the cooperating cover bracket engaging the hanger and the cross bracket by means of the two screws.

4. The overflow cover assembly of claim 1, wherein the screws are not visible when the overflow cover assembly is appropriately engaged over the port of the overflow system.

5. The overflow cover assembly of claim 1, wherein the cover piece includes ports in a lower periphery portion thereof through which water reaching the level of the ports enters the overflow system.

6. The overflow cover assembly of claim 1 that replaces a one screw overflow cover.

7. The overflow cover assembly of claim 1 that replaces a two screw overflow cover.

* * * * *